US005743567A

United States Patent [19]

Warther

[11] Patent Number: 5,743,567

[45] **Date of Patent: *Apr. 28, 1998**

[54] INTEGRAL PRINTED SHEET PRODUCTS

[75] Inventor: Richard O. Warther, West Chester, Pa.

[73] Assignee: Vanguard Identification Systems, Inc., Exton, Pa.

[ * ] Notice: The term of this patent shall not extend beyond the expiration date of Pat. No. 5,495,981.

[21] Appl. No.: 724,077

[22] Filed: Sep. 30, 1996

Related U.S. Application Data

[63] Continuation-in-part of Ser. No. 482,634, Jun. 7, 1995, which is a continuation-in-part of Ser. No. 191,975, Feb. 4, 1994, Pat. No. 5,495,981, which is a continuation-in-part of Ser. No. 620,236, Nov. 29, 1990, Pat. No. 5,180,824, which is a continuation-in-part of Ser. No. 502,005, Mar. 30, 1990, Pat. No. 5,978,146.

[51] Int. Cl.[6] ..... B42D 15/00

[52] U.S. Cl. ..... 283/61; 283/62; 283/904

[58] Field of Search ..... 283/81, 83, 61, 283/62, 116, 904

[56] References Cited

U.S. PATENT DOCUMENTS

| | | | |
|---|---|---|---|
| 1,795,291 | 3/1931 | Dunn . | |
| 1,957,374 | 5/1934 | Unger . | |
| 2,256,399 | 9/1941 | MacHarg | 283/116 X |
| 2,312,204 | 2/1943 | Weindel, Jr. . | |
| 2,357,641 | 9/1944 | Evalt . | |
| 2,363,472 | 11/1944 | Ritter | 283/116 X |
| 2,616,612 | 11/1952 | Guttman . | |
| 2,812,601 | 11/1957 | Hines . | |
| 2,865,120 | 12/1958 | Hines . | |
| 3,062,431 | 11/1962 | Rabenold . | |
| 3,068,140 | 12/1962 | Biddle . | |
| 3,093,296 | 6/1963 | Wood . | |
| 3,140,818 | 7/1964 | Sheldon . | |
| 3,152,901 | 10/1964 | Johnson . | |
| 3,364,049 | 1/1968 | Deak et al. | 283/904 |

(List continued on next page.)

FOREIGN PATENT DOCUMENTS

| | | |
|---|---|---|
| 2225001 | 10/1994 | France . |
| 2-265796 | 10/1990 | Japan . |
| 89/07052 | 8/1989 | WIPO . |

OTHER PUBLICATIONS

Photocopy of mailer insert entitled "Blockbuster Universal Membership Card", Stik/Strip Laminating Co., Inc., Edmond, OK, Jul., 1994 (2 pp.).

Catalog sheet "The Prodigy Label Printer", Fargo Electronics, Incorporated, Prairie, MN, 1990, 2 sides.

H. Bailey and B. Wray, "Photographic Bar Code Labels", *Identification Journal*, Jan./Feb. 1988, pp. 16–19.

*Primary Examiner*—A. L. Pitts
*Assistant Examiner*—Julie A. Krolikowski
*Attorney, Agent, or Firm*—Panitch Schwarze Jacobs & Nadel, P.C.

[57] ABSTRACT

An integral printed sheet product includes a planar core formed by first and second strips of different materials positioned side-by-side, the second core strip being printed on a first major side with a plurality variable data fields, the variable data fields being spaced apart from one another on the second core strip, each variable data field being printed with a unique code, the codes printed in all of the variable data fields of the sheet product being identical. A first cover strip is integrally secured to each of the first and second core strips holding the first and second core strips in side by side position. The first cover strip only partially covers the second major planar side of the core and at least partially covers each of the first and second core strips while extending completely across the second major side of the core and the first and second core strips. Scoring extends at least sufficiently through the sheet product in the second core strip to define at least a first card element removable from a remainder of the sheet product with the second variable data field and only a portion of the second core strip. At least the first variable data field is left on an integral remainder of the sheet product including at least the first core strip.

30 Claims, 4 Drawing Sheets

U.S. PATENT DOCUMENTS 3,583,317 6/1971 Gibson .
3,674,622 7/1972 Plasse .
3,676,644 7/1972 Vaccaro et al. .
3,679,448 7/1972 Tramposch .
3,679,449 7/1972 Nagot et al. .
3,684,869 8/1972 Reiter .
3,697,101 10/1972 Loos et al. ..... 283/62
3,716,439 2/1973 Maeda .
3,716,440 2/1973 Ando et al. .
3,808,718 5/1974 Christiansen .
3,895,220 7/1975 Nelson et al. .
3,999,700 12/1976 Chalmers .
4,006,050 2/1977 Hurst et al. .
4,149,305 4/1979 Blumhof .
4,204,639 5/1980 Barber et al. ..... 283/81
4,214,463 7/1980 Blumhof .
4,271,352 6/1981 Thomas .
4,306,433 12/1981 Kelly .
4,425,772 1/1984 Brewer .
4,521,981 6/1985 Kasprzycki et al. .
4,523,088 6/1985 Utsch et al. .
4,536,013 8/1985 Haghiri-Therani et al. ..... 283/904
4,589,687 5/1986 Hannon .
4,630,067 12/1986 Teraoka .
4,637,635 1/1987 Levine ..... 283/81
4,637,712 1/1987 Arnold et al. ..... 283/117
4,641,347 2/1987 Clark et al. .
4,653,775 3/1987 Raphael et al. .
4,712,929 12/1987 Kitaoka .
4,746,830 5/1988 Holland .
4,765,653 8/1988 Fasham et al. ..... 283/116 X
4,824,142 4/1989 Dossche .
4,842,304 6/1989 Jones .
4,857,121 8/1989 Markley et al. ..... 156/277
4,887,763 12/1989 Sano .
4,904,853 2/1990 Yokokawa ..... 283/904 X
4,978,146 12/1990 Warther et al. ..... 283/81
5,165,726 11/1992 Talbott .
5,271,787 12/1993 Hoffmann et al. ..... 283/116 X
5,294,041 3/1994 Whiteside .
5,439,255 8/1995 McIntire et al. ..... 283/62
5,489,123 2/1996 Roshkoff .
5,495,981 3/1996 Warther ..... 283/904 X
5,507,526 4/1996 Petkovsek .
5,529,345 6/1996 Kohls ..... 283/62 X
5,533,459 7/1996 Fontana ..... 283/81 X

INTEGRAL PRINTED SHEET PRODUCTS

RELATED APPLICATION

This application is a continuation-in-part of U.S. application Ser. No. 08/482,634 filed Jun. 7, 1995 which is a continuation-in-part of U.S. application Ser. No. 08/191,975 filed Feb. 4, 1994, now U.S. Pat. No. 5,495,981, which is a continuation-in-part of U.S. application Ser. No. 07/620,236 filed Nov. 29, 1990, now U.S. Pat. No. 5,180,824, which is a continuation-in-part of U.S. application Ser. No. 07/502,005 filed Mar. 30, 1990, now U.S. Pat. No. 4,978,146.

FIELD OF THE INVENTION

The present invention relates to sheet products and, in particular, to printed form sheet products with sets of uniquely encoded transaction cards, tags, labels and other removable card elements.

BACKGROUND OF THE INVENTION

A substantial market has developed in recent years for inexpensively manufactured, individually encoded transaction cards for such uses as store credit cards, membership cards, I.D. cards, etc. Such cards typically bear a unique code in at least a machine readable format, such as a bar code format, to permit automatic machine scanning of the codes. Such cards typically were supplied in sheets of multiple sets with one or more labels, adhesive tags, etc. being supplied with each set and bearing the same individual code number as the transaction elements for attachment to separate application forms, membership lists, etc. A common method to supply such sheets was printing in multiple, separate steps, individual sheets of uniquely encoded, typically sequentially numbered, transaction cards, printing separate strips of release paper-backed adhesive labels with the same unique codes as the cards, in the same sequence as the codes appear on the cards of the sheets, and manually attaching the strips bearing the labels with code numbers to each sheet of cards so that the coded labels adjoin the transaction cards bearing the same unique codes.

In practice, this seemingly simple, straightforward method was very labor intensive. The appropriate labels for each sheet of cards had to be identified and applied by hand to the sheet so that the labels properly adjoined the associated transaction elements. Because this correlation of the separate elements was done manually, considerable time and effort also had to be spent in checking the final product to assure accuracy.

In addition, because the transaction card sheets and the label strips had to be separately printed, more time was needed to complete the task, particularly if the same printer had to be used to print the transaction card sheets and the label strips. Alternatively, several printers must be available to simultaneously print the card sheets and label strips.

U.S. Pat. No. 4,978,146 discloses, among other things, a printed sheet product including multiple, removable, transaction cards, which each bear a unique code in both machine readable format (e.g. bar code) as well as conventional human readable characters and adhesive labels printed on and cut from the same sheet and the same core material of the sheet forming the core of the transaction cards. An adhesive backing is provided along the sheet underlying the labels so that the labels can be removed and attached to an application form, a membership list, or other record bearing information identifying the recipient of the transaction card (s). The core of the single sheet would be printed with the unique codes of each transaction element and label in one pass, thereby ensuring complete integrity between the codes of each card and each adjoining label.

While the aforesaid sheet product afforded one hundred percent accuracy and integrity between the individual, removable transaction elements and labels, there remained a continuing integrity problem. End users could still mismatch the removable labels when applying them to the separate application forms, membership lists, etc. While only a very small percentage of such labels might be mismatched, they still represent a significant absolute number given the total number of cards which might be distributed, for example, by a pharmacy chain, grocery chain or movie rental chain.

SUMMARY OF THE INVENTION

In one aspect the invention is an integral printed sheet product comprising: a planar core having first and second opposing major planar sides, the core being formed by first and second strips of different materials positioned side-by-side, the second core strip being printed on the first major side of the core with a plurality variable data fields, the variable data fields being spaced apart from one another on the second core strip, each variable data field being printed with a unique code, the codes printed in all of the variable data fields of the sheet product being identical; a first cover strip integrally secured to each of the first and second core strips holding the first and second core strips in side by side position, the first cover strip only partially covering the second major planar side of the core and at least partially covering each of the first and second core strips while extending completely across the second major side of the core and the first and second core strips; and scoring extending at least sufficiently through the sheet product in the second core strip to define at least a first card element removable from a remainder of the sheet product, the scoring separating at least first and second variable data fields of the plurality, the first removable card element including at least the second variable data field and only a portion of the second core strip, at least the first variable data field being left on an integral remainder of the sheet product including at least the first core strip.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings which are diagrammatic.

DETAILED DESCRIPTION OF PREFERRED EMBODIMENTS

Figure 1:
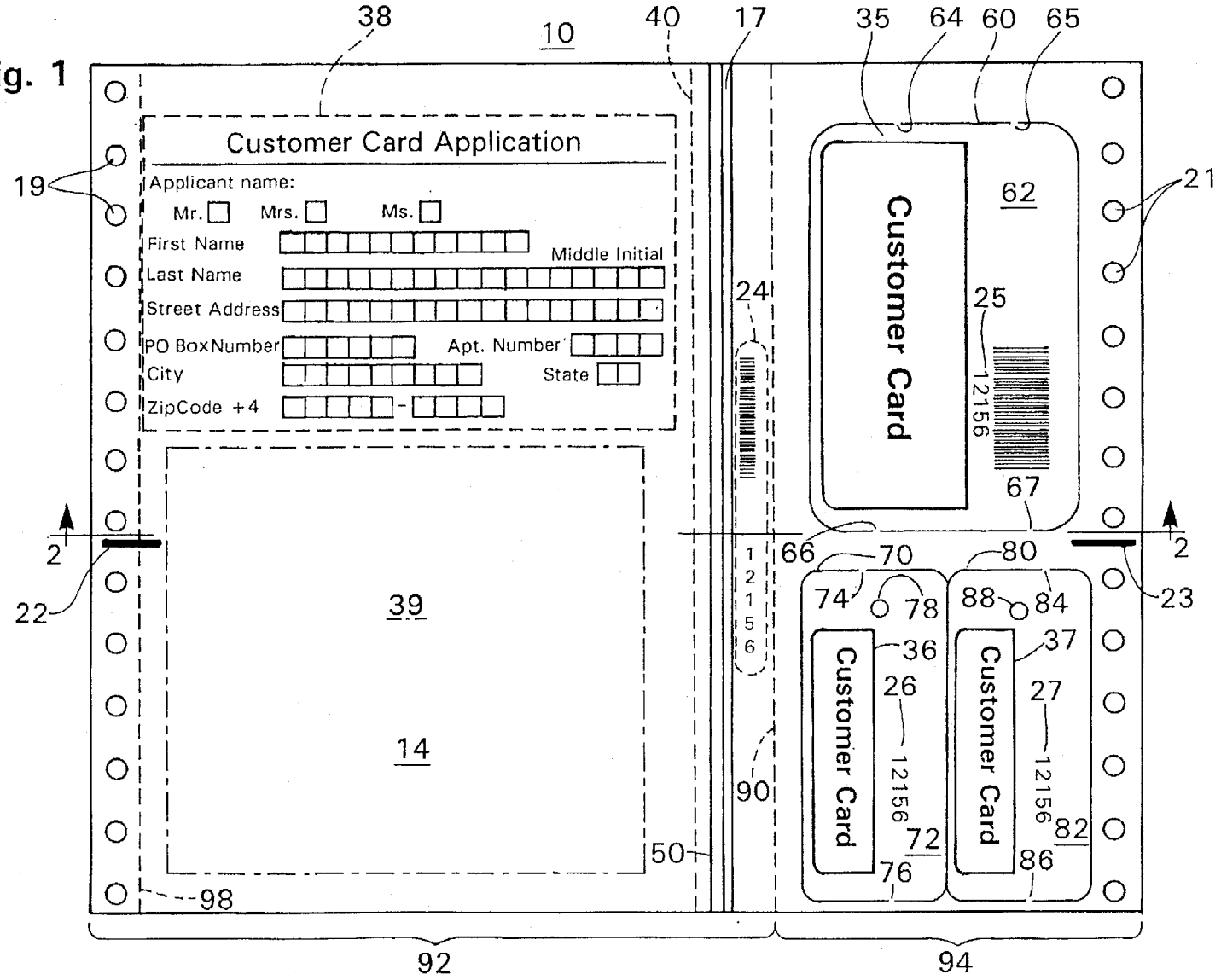
FIG. 1 is a first major planar side of a first embodiment individual printed sheet product of the invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the and designated parts thereof. The terminology includes the words above specifically mentioned, derivatives thereof and words of similar import.

Figure 2:
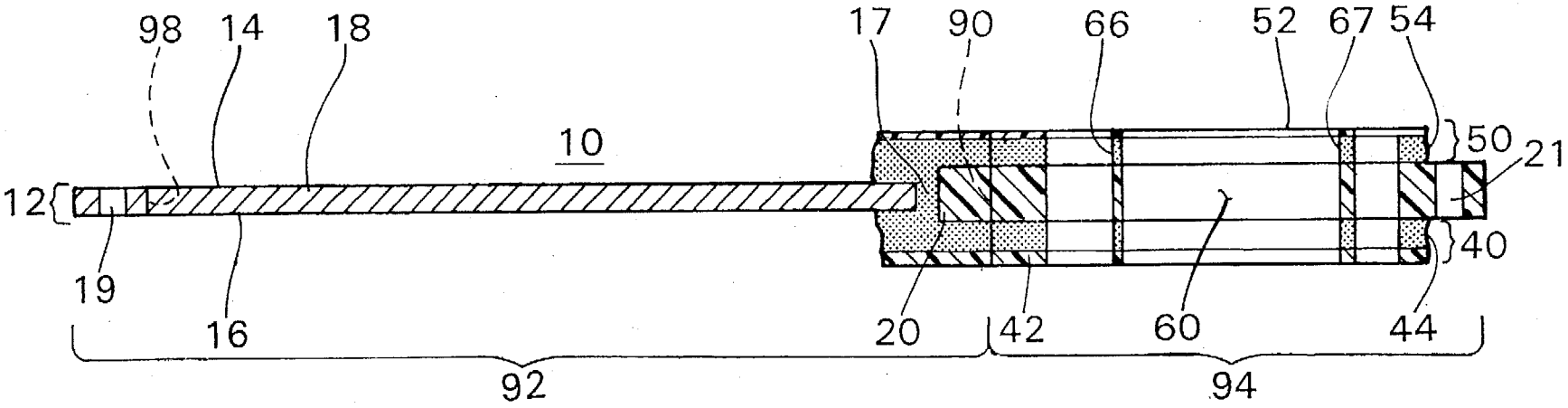
FIG. 2 is a cross section taken along the lines 2—2 in FIG. 1.

In the drawings, like numerals indicate like elements. FIGS. 1 and 2 depict an integral, individual printed sheet product 10 of the present invention which is an application form that maintains the integrity of the identification of uniquely encoded transaction card elements when the form is completed. Sheet product 10 is merely one of a number which would be produced at the same time in a manner to be subsequently described, each with a different unique code.

The individual sheet product 10 includes a planar core indicated generally at 12 having first and second opposing major planar sides 14 and 16, the first or "front" major planar side 14 being seen in FIG. 1. As is best shown in FIG. 2, core 12 is formed by first and second core strips 18, 20. The core strips 18, 20 are planar and flexible and, according to an important aspect of the invention, are of different materials each of which can accept printing. The strips 18 and 20 are positioned side-by-side, to define preferably monolayer core 12 of one thickness of material with a junction or joint 17. Machine or tractor feed holes 19 and 21 are located along the free side edge margins of each strip 18 and 20, respectively.

Referring back to FIG. 1, the second core strip 20 is printed on the first major planar side 14 of the core 12 with a plurality of spaced-apart, variable data fields, four variable data fields being identified at 24, 25, 26 and 27. Each variable data field 24–27 is printed with a unique code and the codes printed in the variable data field 24–27 are identical, namely, "12156" in the indicated example. The variable data fields 24-27 constitute a set. The location of the variable data fields 24–27 would remain the same in each sheet product 10 but the unique code printed in the fields would change from sheet product 10 to sheet product. In addition to being printed in human readable characters, the codes are printed in machine readable formats, bar codes being depicted in the first and second variable data fields 24, 25.

In addition to the variable data fields 24–27, the sheet product 10 includes printed static graphic fields 35–39. The static graphic fields 35–39 would remain unchanged from printed sheet product 10 to printed sheat product within a plurality or set or run of such products 10. Fields 35–37 of the second strip 20 are associated with the second, third and fourth variable data fields 25–27, respectively. The first core strip 18 has preprinted static graphic fields indicated generally at 38 and 39. Static graphic field 38 is an identification block preprinted to indicate where on the first core strip 18, a name and address of an individual is manually entered to identify an individual to whom the unique code of the sheet product 10 is assigned. The particular formats of the various static graphic fields 34–39 are not important to the present invention beyond the provision on the first planar strip 18 of a location to manually enter an identification of an individual to whom the unique code of the sheet product 10 is assigned. Also, preferably printed on each core strip 18 and 20 is at least one visible optical alignment mark 22 and 23, respectively.

Referring back to FIG. 2, a first cover strip indicated generally at 40 is integrally secured to each of the first and second core strips 18 and 20 holding the first and second core strips 18, 20 in side-by-side position as shown in FIGS. 1 and 2. The first cover strip 40 partially covers the second or "rear" major planar side 16 of the core 12 and at least partially covers each of the first and second core strips 18 and 20 while preferably extending completely across the second major planar side 16 and each of the first and second core strips 18 and 20 (top to bottom in FIG. 1). The first cover strip 40 covers enough of each of the first and second core strips 18 and 20 to assure that each is integrally secured with the other. The first cover strip 40 may be provided by a polymer film 42 and an appropriate adhesive layer 44.

In the depicted embodiment 10, a second cover strip 50 is integrally secured to each of the first and second core strips 18 and 20, partially covering the first, front major planar side 14 of the core 12 and each of the first and second core strips 18 and 20, extending completely across the first major side 14 and each of the first and second core strips 18 and 20, again top to bottom in FIG. 1. In embodiment 10, both cover strips extend essentially the full width of second core strip 20 within the holes 21.

Still referring to FIG. 1, scoring indicated generally at 60 is provided in the sheet product 10 and extends at least sufficiently through and along the sheet product 10 and through the second core strip 20 and, in this embodiment 10, through the provided first cover strip 40 and the second cover strip 50, to define at least one transaction card element 62 removable from a remainder of the sheet product 10. The scoring 60 separates the second variable data field 25 from the other data fields 24, 26, 27.

The removable card element 62 includes at least the second variable data field 25 of the plurality of variable data fields 24–27 but only a portion of second core strip 20, the first cover strip 40 and the second cover strip 50, if provided. Preferably, one or more bridges of continuous material 64–67 spanning the removable card element 62 and the remainder of the sheet product 10 on opposite sides of the card element 62 releasably retain the card element 62 in the sheet product 10 until removed. Scoring indicated at 70 and at 80 through the sheet product 10 in the second core strip 20, define two smaller card elements 72, 82, respectively, which are also removable from the sheet product 10. Each is printed with a separate variable data field 26, 27 each bearing the code, "12156", which is unique to sheet product 10 and common to all of its variable data fields 24–27. Again, bridges 74, 76 and 84, 86 at opposing ends of each card element 72, 82 releasably retain each element 72, 82 in the sheet product 10 until the elements 72, 82 are manually removed by breaking the bridges. Preferably, each card element 72, 82 is provided with a closed perimeter opening 78, 88 by the scoring to enable the element 72, 82 to be attached to a key ring or other key holder (neither depicted).

Still referring to FIG. 1, according to another important aspect of the present invention, a line of perforations 90 or other line of weakness extends across the sheet product 10 and sufficiently through the second core strip 20, the first cover strip 40 and the second cover strip 50, if provided, to define first and second separable sheet components 92 and 94. At least one of the printed variable data fields, the first variable data field 24 in this embodiment, is not made part of any removable card element 62, 72, 82 but instead is left on an integral remainder of the sheet product 10 which includes the first core strip 18. The first separable sheet component 92 is integral and includes the entirety of the first core strip 14 and a portion of the second core strip 20 including the first printed variable data field 24. The second separable component 94 includes each of the removable card elements 62, 72 and 82 and a scrap portion of the second core strip 16, which is connected to and releasably retains each of the removable card elements 62, 72, 82. The second separable component 94 can be separated from the first component 92 and given to a customer or client who keeps the removable card element(s) 62, 72, 82. The first separable sheet component 92 is retained with identification information of the individual to whom the second separable sheet component 94 was given. The first variable data field 24 with the code unique to all of the removable card elements 62, 72, 82 remains attached with the identification information (which is manually entered into the static graphic field 38) and kept as a permanent record by the card provider. If desired, a vertical line of perforations 98 or other form of line of weakness can be provided along the free side edge of the first core strip 18 to permit separation of a distal edge portion of the first core strip 18 with the tractor feed holes 19.

Specific manufacturing details and materials, including preferred materials and manufacturing techniques, have been disclosed in prior U.S. Pat. Nos. 4,978,146 and/or 5,495,981 and application Ser. No. 08/482,634, each of which is incorporated by reference herein in its entirety. Suggestedly, first core strip 18 comprises and, preferably, consists essentially of cellulose material, namely paper stock, to reduce the overall cost of the product 10. The second core strip 20 comprises a polymer material stiffer and thicker than the paper sheet stock to provide stiffness and thickness to the card elements 62, 72, 82. The polymer material is one that accepts printing, preferably one which accepts laser printing. Strip 20 preferably consists essentially of such polymer material.

The first cover strip 40 on the second or rear major planar side 16 of the planar core 12 suggestedly comprises or consists essentially of a polymer film carrier 42 bonded to core 12 with an appropriate adhesive 44. Polyester provides good strength, wear and soil resistance properties to the outer surface of each of the removable card element 62, 72, 82. However, if durability of the removable element(s) is not a factor and reduced cost would be advantageous, the polymer film carrier 42 of the first cover strip 40 can be a less expensive material such as conventional cellophane or 3M brand Magic or Invisible tape or transparent tape, or any of their industry equivalents, with a pressure sensitive adhesive. If provided, the second cover strip 50 on the first, front major planar side 14 of the core 12 and sheet product 10 would suggestedly be a more durable, polyester material that is transparent to visible light or at least infrared light so that the variable data fields beneath the cover strip 50 can be seen by humans, if desired, or at least read by machine such as by infrared scanner.

Sheet product 10 of FIGS. 1 and 2 having polyester cover strips 40 and 50, would be preferred where providing the most durable, removable card elements 62, 72 and 82 and sheet product 10 was desired. While strip 5*c* is shown to extend over the junction 17 between the first and second core strips 18 and 20, only one of the two cover strips, first cover strip 40, need span the junction 17 between the two core strips 18 and 20 for purposes of the present invention. The first cover strip 40 need only have a width sufficient to span the junction 17 to assure that the core strips 18 and 20 remain together during manufacture and use. Cover strip 40 need not extend so far as the scoring 60, 70, 80 or even perforations 90.

Similarly, cover strip 50 need not be provided at all. The primary purpose for providing second cover strip 50 is to protect the faces of the removable card element 62, 72 and 82 and to further prevent tampering with the printed variable data fields. Second cover strip 50 need only span the second core strip 20 overlapping the scoring 60, 70 and 80 defining the removable card elements 62, 72 and 82. The left edge of cover strip 50 might, for example, terminate at a location between the scoring 60 and the first printed variable data field 24, or at a location to the left of variable data field 24 spanning the scoring 60 and first variable data field 24.

Figure 3:
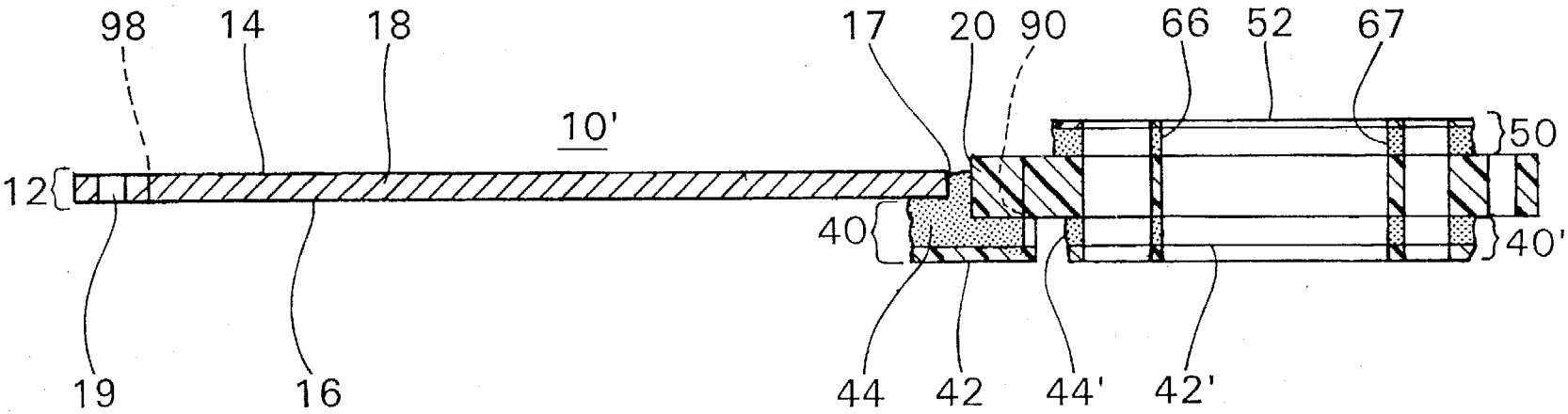
FIG. 3 is a cross section like that of FIG. 2 of another sheet product of the present invention.

FIG. 3 is a cross sectional view similar to FIG. 2 of an alternate sheet product 10' including the same core 12 formed of the same core strips 18 and 20. Sheet product 10' further has, in addition to a first, relatively narrow cover strip 40 spanning the junction 17 between the core strips 18 and 20 and a second cover strip 50 on the front side 18 of the core, a third cover strip 40' on the rear planar side 16 of the sheet product 10' covering only the portion of the second core strip 20 including the removable card element(s) 62, 72, 82, etc. The second core strip 50 would only be sufficiently wide to also cover those removable card elements. The first variable data field 24 would remain coupled with the first core strip 18 by only first cover strip 40. Cover strip 40 would preferably be the less expensive cellophane or other transparent, adhesive tape.

Sheet products 10 and 10' may be manufactured in a variety of ways. The present invention provides sheet products 10, 10' which may be manufactured more quickly and inexpensively and with greater data integrity than previous similar products. The present invention is most valuable where a large number of individual sheet products, e.g. thousands need to be or can be manufactured at a given time or in a single run to fill an order.

Figure 4:
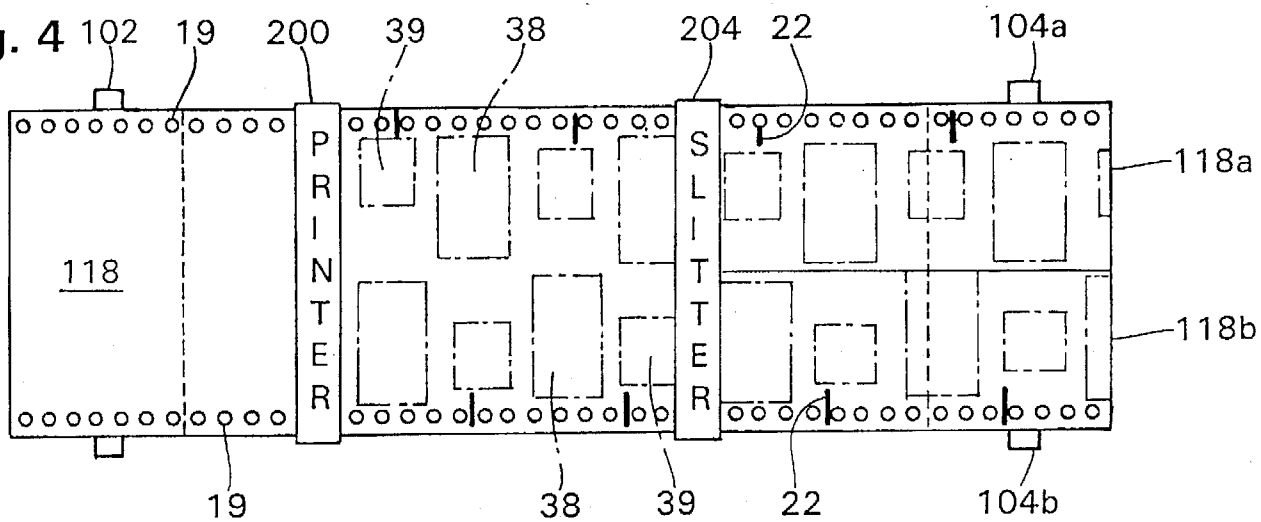
FIG. 4 depicts manufacture of a portion of a continuous length of a first printed sheet material.

One preferred method of forming sheet products 10, 10' is now explained with reference to FIGS. 4–6. Referring to FIG. 4, a continuous strip 118 of paper stock is fed from a single continuous roll 102 and is printed in a conventional fashion, such as offset printed, with consecutive sets of the static graphic fields 38, 39 and optical marks 22 found on the first core strip 18 of the sheet products 10, 10'. Strip 118 can have a width equal to the width of core strip 18. However, for convenience and reduced cost, it may be desirable to simultaneously print two or more columns of the static graphic fields 38, 39 in opposite or reversed directions on the elongated continuous strip 118 which can thereafter be slit into separate, elongated strips 118*a*, 118*b*, which can be simultaneously wound on separate rolls 104*a*, 104*b*. Machine or tractor feed holes can be supplied originally in strip 118 as depicted or added at any time during or after the process. Printing two columns of static graphic fields on paper stock supplied with tractor holes 19 along the side edges is very effective. The elongated flexible unprinted feed stock 118 such as paper with tractor holes 19, along its two lateral side edges is continuously fed through an offset printer 200 which prints two columns of consecutive sets of static graphic fields 38, 39 and optical alignment marks 22, side-by-side but facing in opposite directions along stock 118. Stock 118 may be simultaneously or consecutively printed with sets of static data fields at the same uniform intervals on both of its major sides. The printed stock is then passed through a slitter 204, which splits the stock 118 longitudinally through its center to provide two separate strips 118*a*, 118*b* of continuous stock each bearing consecutive sets of the static graphic fields 38, 39.

Figure 5:
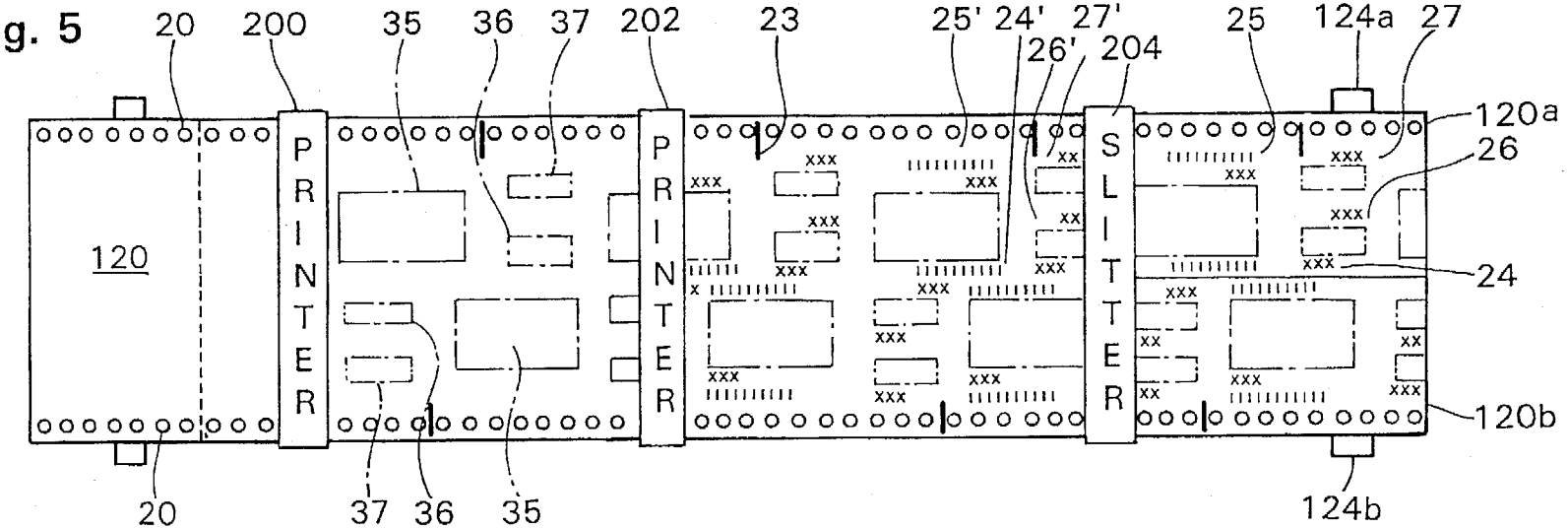
FIG. 5 depicts manufacture of a portion of a continuous length of a second printed sheet material.

Referring to FIG. 5, an elongated continuous strip 120 of the selected polymer material used to provide second core strip 20 is offset printed with at least one column and preferably two columns of sets of static graphic fields 35–37. Because the identified polymer strip materials tend to stretch, tractor or machine feed holes 20 should provided along both free edges of elongated strip 120 and used to control the tensioning of the strip 120 during processing to obtain a uniform stretch of the strip 120 such that the static graphic fields and variable data fields are in alignment. Strip 120 preferably is first offset printed with consecutive side-by-side sets of the static graphic fields 35–37 and optical alignment marks 23, again facing in opposite or reversed directions. Next, the elongated strip 120 is preferably run through a variable data field printer 202, such as a computer controlled laser printer, which prints sets of the variable data fields 24–27, 24'–27', etc. on the strip 120, incrementing the code of each variable data field set as it is printed. Next, strip 120 is preferably slit into two separate strips 120*a*, 120*b*, which are simultaneously wound into separate rolls 124*a*, 124*b*. Again, strip 120 can be offset and laser printed on one or both major planar sides simultaneously or sequentially, then slit and separately wound in two rolls in a single continuous operation as shown. Optical marks can be printed in either fashion.

Figure 6:
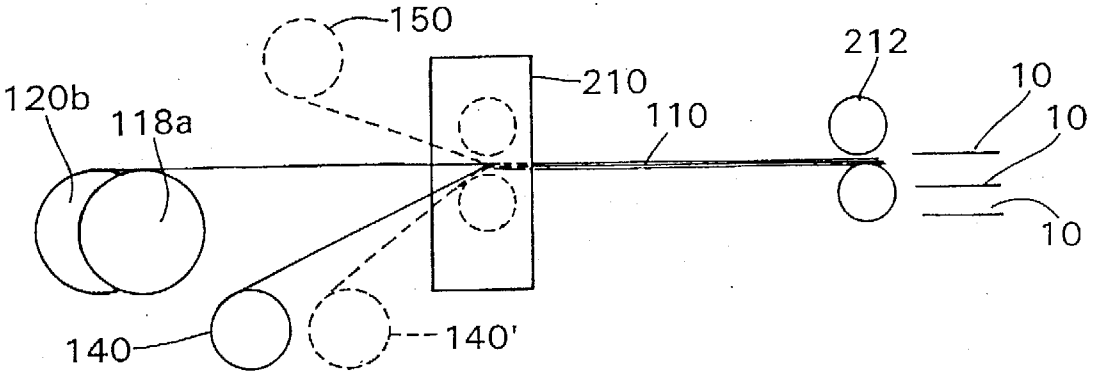
FIG. 6 depicts manufacture of a plurality of the sheet products of the present invention using the printed sheet materials of FIGS. 4 and 5.

Referring to FIG. 6, one strip from each of the two sets printed strips 118*a*, 118*b* and 120*a*, 120*b* are fed with at least one and up to three elongated cover strips 140, 150, 140', through a bonder 210 which may be a pair of nip rolls where only cover strips with a pressure sensitive adhesive is being used or heated roll(s) or lighted roll(s) where, for example, a polyester continuous strip 140 and/or 150, 140' with more aggressive heat or light activated adhesive is used to laminate cover strip(s) 140, 150 and/or 140' to core strips 118*a* and/or 120*b*. Preferably, the paper elongated core strip 118*a* is simply fed at a desired processing speed through the bonder 210. Second elongated core strip 120*b* would be fed under tension at a speed to match the speed of the first (paper) core strip 118*a* and at a stretch to match the intervals between the optical marks 22 on the first core strip 118*a*. Optical marks 22 on elongated strip 118*a* and marks 23 on strip 120*b* can be used to control the feed speed of strip 120*b* to strip 118*a* to keep the various printed field sets in alignment. After bonding, the resulting elongated, continuous, intermediate sheet product 110 can be scored to define a plurality of the individual sheet products 10 (or 10') with removable transaction card elements 62, 72, 82 and perforation lines 90, 98 by conventional means, such as opposing roll cutters 212.

Figure 7:
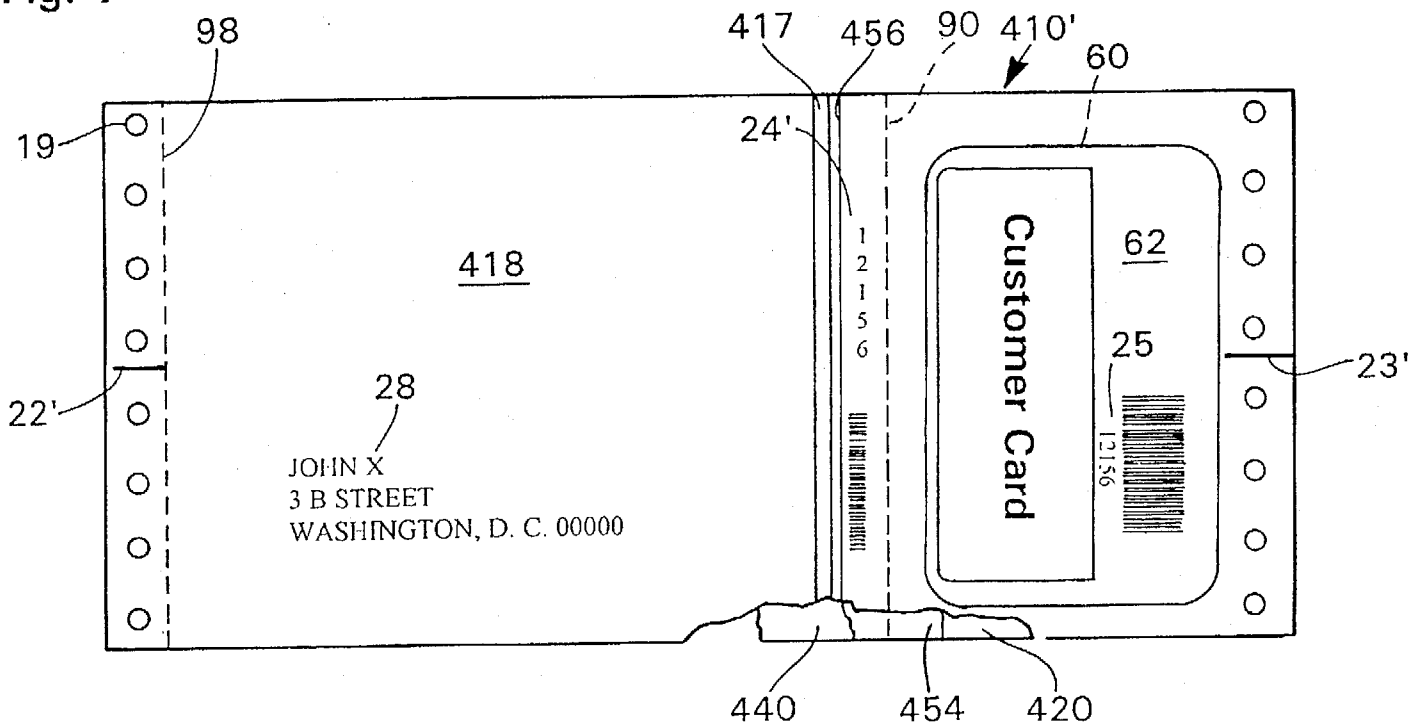
FIG. 7 depicts another individual sheet product of the present invention partially broken in the lower center.

In addition to making the sheet products 10, 10' previously described, the aforesaid method of using an inexpensive cellophane or transparent tape with pressure sensitive adhesive could also be used to join together strips of different materials, both of which are printed with variable data fields like the sheet products 410 of U.S. Pat. No. 5,495,981, to reduce the costs of such sheet products. One such individual sheet product 410' is shown in FIG. 7. Sheet product 410 has a cross section like sheet product 10' of FIG. 3 except that the first core sheet indicated at 418 in FIG. 7 bears, in addition to any static graphic field (not depicted), a variable data field 28 with the printed name and address of an individual to whom the transaction card 62 is being assigned. This product permits the two core strips to be separately printed, for example, the information for the first core strip to be supplied by a business seeking to distribute the transaction card and the second strip being supplied by the card manufacturer. The resulting sheet product 410' can be used as a mailer with a standard size envelope as indicated in U.S. Pat. No. 5,495,981. Individual sheet products 410' can be fabricated using continuous, integral core strips like strips 118*a*/118*b* with 120*a*/120*b* in the manner previously described. After joining, the continuous strips are scored to separate the individual sheet products 410' and to define the removable transaction card element(s) 62. The polymer strip(s) 118*a*/118*b* would be covered with one or two cover strips after being printed but before slitting. In such embodiments, the core strips 418 and 420 would be joined at their junction by a thin, inexpensive cellophane or other like transparent tape 440 and the more expensive polyester cover strips 454, 456 applied only over the front and rear sides of the portion of second core strip 420 that include the removable card element(s) 62.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An integral printed sheet product comprising:

a planar core having first and second opposing major planar sides, the core being formed by first and second strips of different materials positioned side-by-side, the second core strip being printed on the first major side of the core with a plurality of variable data fields, the variable data fields being spaced apart from one another on the second core strip, each variable data field of the plurality being printed with a unique code, the codes printed in all of the variable data fields of the sheet product being identical;

a first cover strip integrally secured to each of the first and second core strips holding the first and second core strips in side by side position, the first cover strip only partially covering the second major planar side of the core and at least partially covering each of the first and second core strips while extending completely across the second major side of the core and the first and second core strips; and scoring extending at least sufficiently through the sheet product in the second core strip to define at least a first card element removable from a remainder of the sheet product, the scoring separating at least first and second variable data fields of the plurality, the first removable card element including at least the second variable data field and only a portion of the second core strip, at least the first variable data field being left on an integral remainder of the sheet product including at least the first core strip.

2. The sheet product of claim 1 further comprising scoring extending across the sheet product and sufficiently through the second core strip and the first cover strip to define first and second separable sheet components, the first separable sheet component including the first core strip and a portion of the second core strip including at least the first variable data field, the second separable sheet component including the first removable card element with the second variable data field.

3. The sheet product of claim 1 wherein the first core strip includes an identification block preprinted to indicate where on the first core strip a name and address of an individual is manually entered to identify an individual to whom the unique code is assigned.

4. The sheet product of claim 1 wherein said scoring defines a second card element with a third variable data field of the plurality removable from a remainder of the sheet product.

5. The sheet product of claim 1 further comprising two sets of tractor feed holes extending across opposing distal edge portions of the first and second core strips.

6. The sheet product of claim 1 further comprising a second cover strip integrally secured to each of the first and second core strips, partially covering the first major planar side of the core and at least partially covering each of the first and second core strips while extending completely across the first major side of the core, the second cover strip covering at least the first and second variable data fields and the scoring defining the at least one removable card element extending through the second cover strip.

7. The sheet product of claim 1 wherein the first cover strip includes a transparent film carrier and a pressure sensitive adhesive between the film carrier and the first and second core strips.

8. The sheet product of claim 1 wherein the first core strip comprises a cellulose material and the second core strip comprises a polymer material.

9. The sheet product of claim 1 wherein the second core strip consists essentially of a polymer material.

10. The sheet product of claim 9 wherein the first core strip consists essentially of a cellulose material.

11. The sheet product of claim 1 wherein the scoring defines a closed perimeter opening through the first removable card element.

12. The sheet product of claim 1 further comprising a name and address of an individual assigned the codes printed in the variable data fields, the name and address being machine printed on the first core strip on one of the opposing major planar sides of the core.

13. The sheet product of claim 1 further comprising a second, transparent cover strip integrally secured with and covering at least part of the second core strip while extending across the second core strip in a direction parallel to a joint between the side-by-side first and second core strips, the second cover strip covering at least a part of the second core strip bearing the second variable data field, and the scoring defining the at least first removable card element also extending through the second cover strip.

14. The sheet product of claim 13 wherein the first cover strip is also transparent and extends completely across the core in a direction parallel to the joint.

15. The sheet product of claim 13 further comprising scoring extending across and sufficiently through the sheet product in the second core strip to define first and second separable sheet components, the first separable sheet component including the first core strip and a portion of the second core strip including at least the first variable data field, the second separable sheet component including at least the first removable card element with the second variable data field.

16. The sheet product of claim 15 wherein at least one of the first and second cover strips spans a portion of the second core strip including the first variable data field.

17. An integral printed sheet product comprising:

a planar core having first and second opposing major planar sides, the core being formed by first and second core flexible strips of different materials positioned side-by-side without overlap, at least the second core strip being printed on the first major side of the core with a plurality of variable data fields, the variable data fields being spaced apart from one another on the second core strip, at least two of the variable data fields being printed with a unique code, and any codes printed in the variable data fields of the sheet product being identical;

a first cover strip integrally secured to each of the first and second core strips holding the first and second core strips in parallel, side-by-side position, the first cover strip only partially covering one of the first and second major planar sides of the core and at least partially covering each of the first and second core strips while extending completely across the one major planar side of the core and the first and second core strips; and first scoring extending at least sufficiently through the sheet product in the second core strip to define at least a first element removable from a remainder of the sheet product, the first scoring separating at least two of the variable data fields of the plurality printed with the unique code, the first removable element including at least one of the at least two variable data fields printed with the unique code and only a portion of the second core strip, at least a remaining one of the two variable data fields printed with the unique code being left on a remainder of the sheet product.

18. The sheet product of claim 17 wherein the first cover strip is also transparent and extends over at least the first removable element, the first scoring extending through the first cover strip.

19. The sheet product of claim 17 further comprising scoring extending across and sufficiently through the sheet product in the second core strip to define first and second separable sheet components, the first separable sheet component including the first core strip and a portion of the second core strip including at least a second one of the variable data fields printed with the unique code, the second separable sheet component including the first removable element with at least the one variable data field printed with the unique code.

20. The sheet product of claim 19 further comprising a transparent, second cover strip integrally secured over at least one of the major planar sides of the second core strip and at least the one variable data field printed with the unique code, the second cover strip extending entirely across at least part of the second core strip and covering at least the first removable element, the first scoring also extending through the second cover strip.

21. The sheet product of claim 20 wherein the first cover strip is also transparent and extends over at least the first removable element, the first scoring extending through the first cover strip.

22. The sheet product of claim 19 wherein further printed on the first major side of the core is a name and address of an individual assigned the unique code printed in the variable data fields of the sheet product.

23. The sheet product of claim 19 further comprising a name and address location printed on the first core strip to permit entry of a name and address of an individual assigned the unique code printed in the variable data fields on the sheet product.

24. The sheet product of claim 23 wherein a surface portion of the core bearing the printed name and address location forms a portion of an exposed outer surface of the sheet product.

25. The sheet product of claim 17 wherein the first core strip is a cellulose based material and the second core strip is a polymer plastic based material.

26. An integral printed sheet product comprising:

a planar core having first and second opposing major planar sides, the core being formed by first and second flexible core strips of different materials positioned side-by-side without overlap;

a first cover strip integrally secured to each of the first and second core strips holding the first and second core strips in parallel, side-by-side position without overlap of the core strips, the first cover strip only partially covering one of the major planar sides of the core and only partially covering at least one of the first and second core strips while extending completely across the one major side of the core and the first and second core strips; and first scoring extending at least sufficiently through the sheet product in the second core strip and through the first cover strip to define at least a first element removable from a remainder of the sheet product.

27. The integral sheet product of claim 26 further comprising a transparent, second cover strip integrally secured to one major side of the second core strip overlapping at least the first removable element, the first scoring extending through the second, transparent cover strip.

28. The integral sheet product of claim 27 wherein the first cover strip is transparent and extends over at least the first removable element, the first scoring also extending through the first cover strip.

29. The integral sheet product of claim 26 wherein the first core strip is a cellulose based material and the second core strip is a polymer plastic based material.

30. The integral sheet product of claim 26 with a unique code printed on the first element and one of the first core strip and the second core strip bearing one of a machine printed name and address of an individual assigned to the unique code and a blank name and address location to enter the name and address of a person assigned the unique code.

* * * * *